US005896682A

United States Patent [19]

Lin

[11] Patent Number: 5,896,682

[45] Date of Patent: Apr. 27, 1999

[54] SHOCK-ABSORBING RIB AND SOLE MOUNTING ARRANGEMENT

[75] Inventor: Ghing-Yi Lin, Taichung Hsien, Taiwan

[73] Assignee: Gnan-Jang Plastics Co., Ltd., Taichung Hsien, Taiwan

[21] Appl. No.: 09/050,641

[22] Filed: Mar. 30, 1998

[51] Int. Cl.[6] ..... A43B 13/20

[52] U.S. Cl. ..... 36/29; 36/35 B

[58] Field of Search ..... 36/29, 35 B, 28, 36/35 R

[56] References Cited

U.S. PATENT DOCUMENTS 1,278,320 9/1918 Elithorpe .
1,517,171 11/1924 Rosenwasser .
5,220,737 6/1993 Edington .
5,313,717 5/1994 Allen et al. .
5,363,570 11/1994 Allen et al. .
5,524,364 6/1996 Cole et al. .

*Primary Examiner*—Ted Kavanaugh
*Attorney, Agent, or Firm*—Bacon & Thomas, PLLC

[57] ABSTRACT

A shock-absorbing rib and sole mounting arrangement includes an insole having at least one through hole, a shock-absorbing rib, the shock-absorbing rib having a flat base layer, at least one flexible water chamber raised from the flat base layer and extended out of the insole through the at least one through hole, and a flexible packing element having a bottom side adhered to the flat base layer around the at least one flexible water chamber and a top side adhered to a bottom wall of the insole, and an outsole directly molded on the bottom wall of the insole over the shock-absorbing rib.

1 Claim, 4 Drawing Sheets

SHOCK-ABSORBING RIB AND SOLE MOUNTING ARRANGEMENT

BACKGROUND OF THE INVENTION

The present invention relates to the installation of a shock-absorbing rib in a sole for shoe, and more particularly to such a shock-absorbing rib and sole mounting arrangement which keeps the shock-absorbing rib firmly in place.

FIG. 1 shows a shock-absorbing rib and sole mounting arrangement according to the prior art. This arrangement comprises an outsole having a recessed portion, a shock-absorbing rib fitted into the recessed portion on the outsole, and an insole covered on the outsole over the shock-absorbing rib. The shock-absorbing rib comprises a flat a flat, elongated base layer, two flexible water chambers respectively raised from two ends of the flat base layer at the top and extended out of respective through holes on the insole, and a narrow water passage in communication between the flexible water chambers. After filling of a liquid into the flexible water chambers through a filling hole, the filling hole is sealed. This mounting arrangement is complicated because a recessed portion must be processed on the top wall of the outsole for receiving the shock-absorbing rib. Furthermore, when the user walks or runs, the shock-absorbing rib tends to be forced out of the recessed portion on the outsole.

SUMMARY OF THE INVENTION

The present invention has been accomplished to provide a shock-absorbing rib and sole mounting arrangement which eliminates the aforesaid drawbacks. It is one object of the present invention to provide a shock-absorbing rib and sole mounting arrangement which is easy to be achieved. It is another object of the present invention to provide a shock-absorbing rib and sole mounting arrangement which keeps the shock-absorbing rib firmly in place when in use. To achieve these and other objects of the present invention, there is provided a shock-absorbing rib and sole mounting arrangement which comprises an insole having at least one through hole, a shock-absorbing rib, the shock-absorbing rib having a flat base layer, at least one flexible water chamber raised from the flat base layer and extended out of the insole through the at least one through hole, and a flexible packing element having a bottom side adhered to the flat base layer around the at least one flexible water chamber and a top side adhered to a bottom wall of the insole, and an outsole directly molded on the bottom wall of the insole over the shock-absorbing rib.

DETAILED DESCRIPTION OF THE PREFERRED EMBODIMENT

Figure 1:
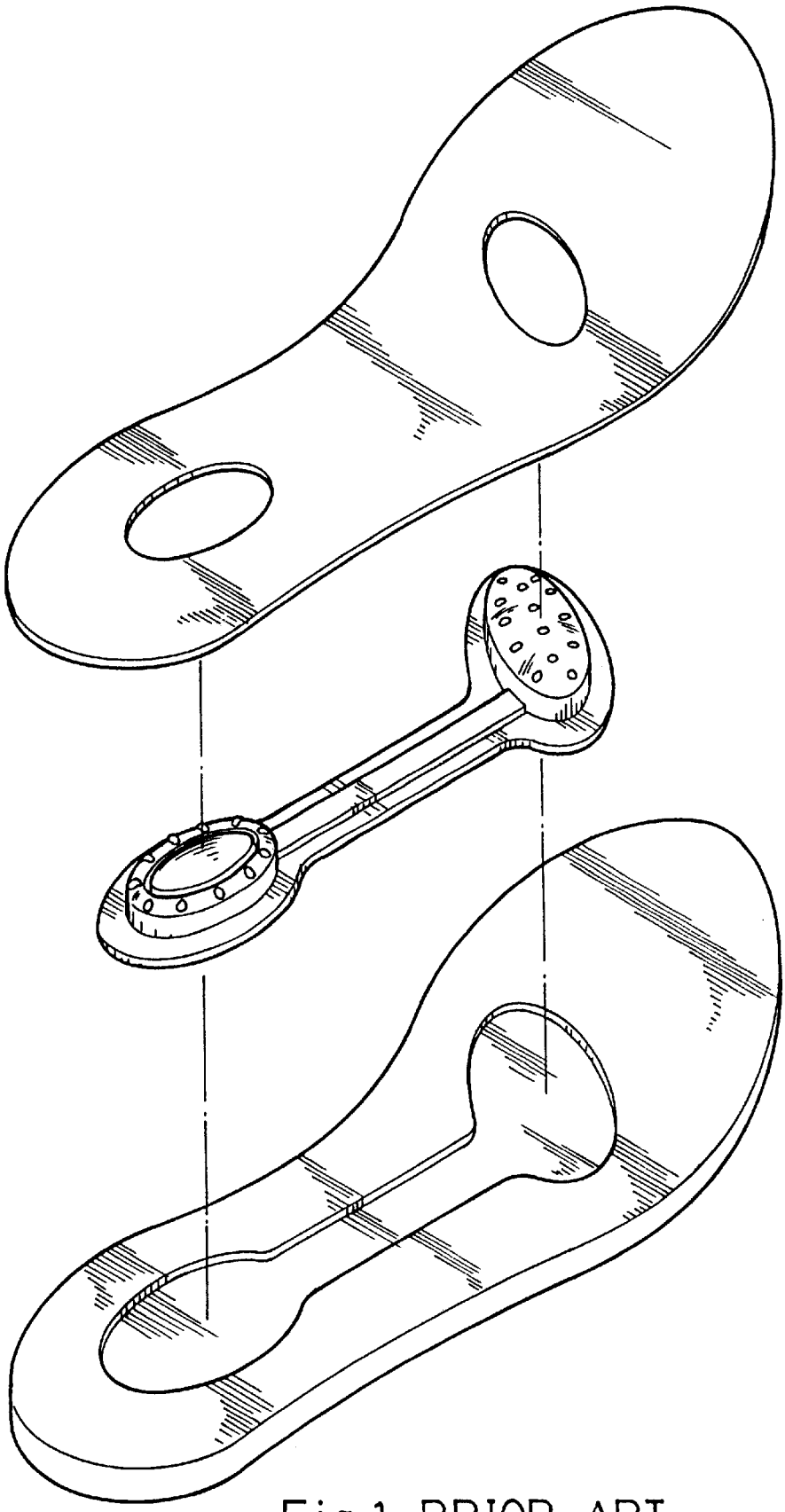
Fig·1 PRIOR ART
FIG. 1 is an exploded view of a shock-absorbing rib and sole mounting arrangement according to the prior art.
Figure 2:
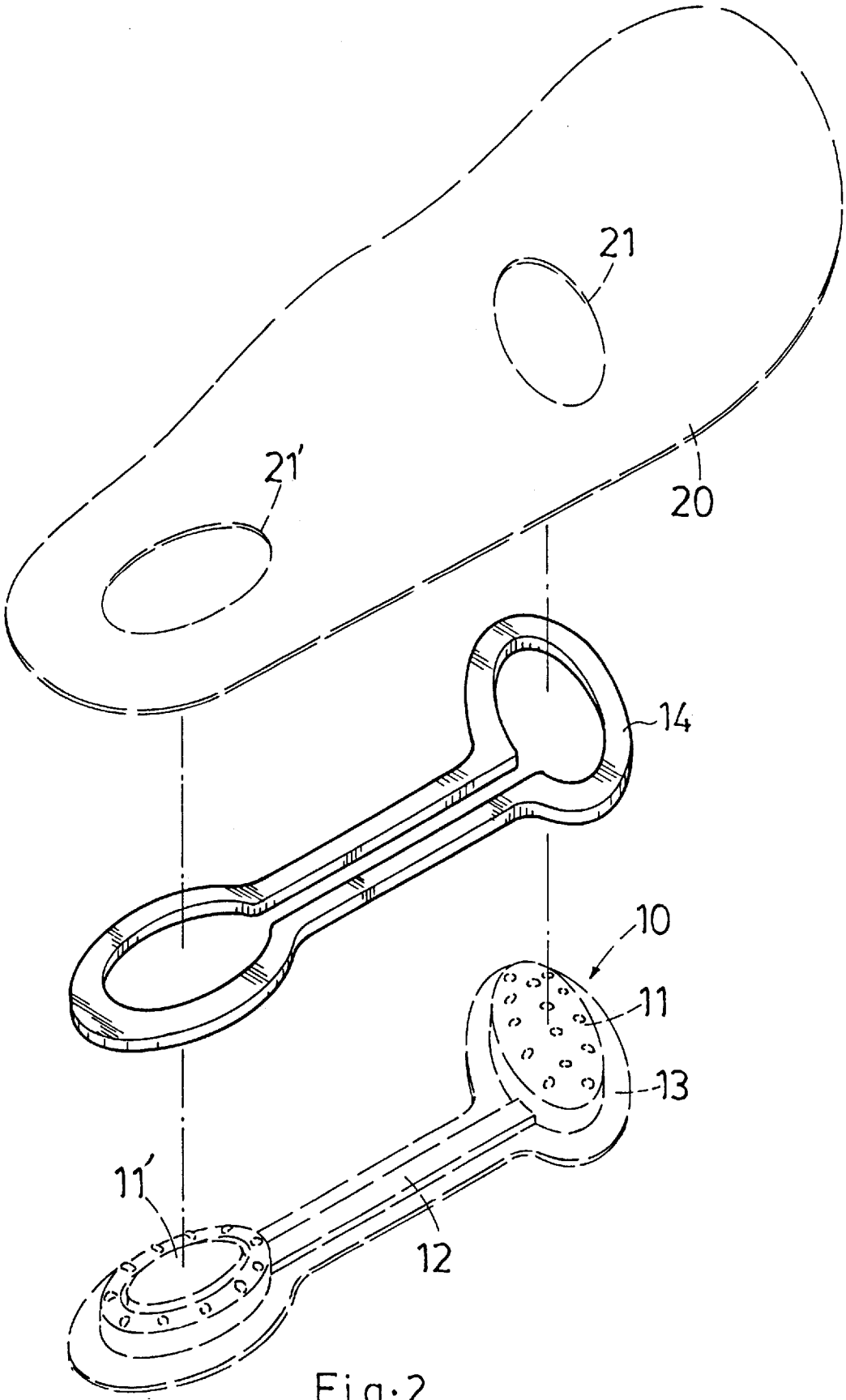
FIG. 2 is an exploded view of a shock-absorbing rib and sole mounting arrangement according to the present invention.
Figure 3:
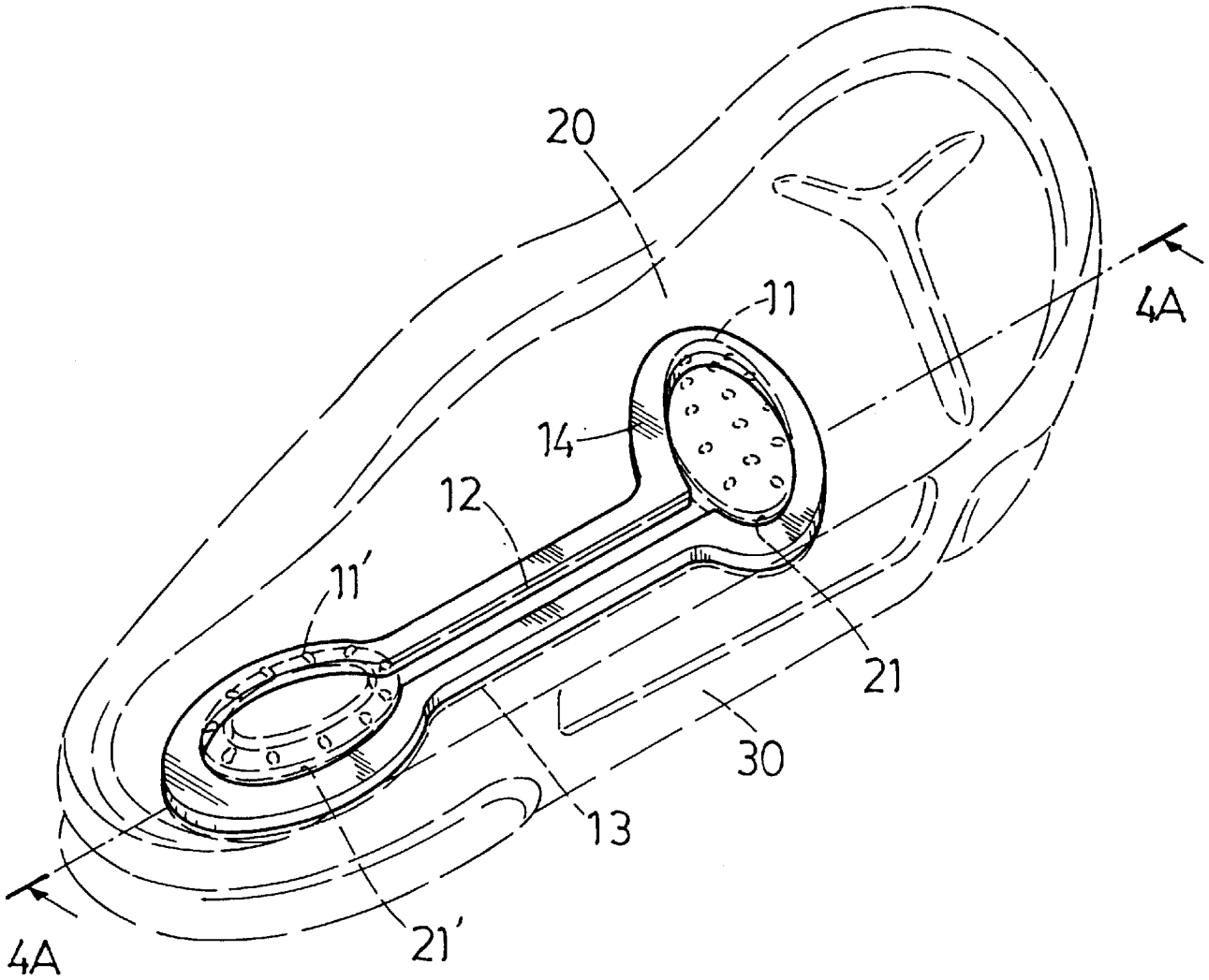
FIG. 3 is a perspective view of the present invention when installed.
Figure 4A:
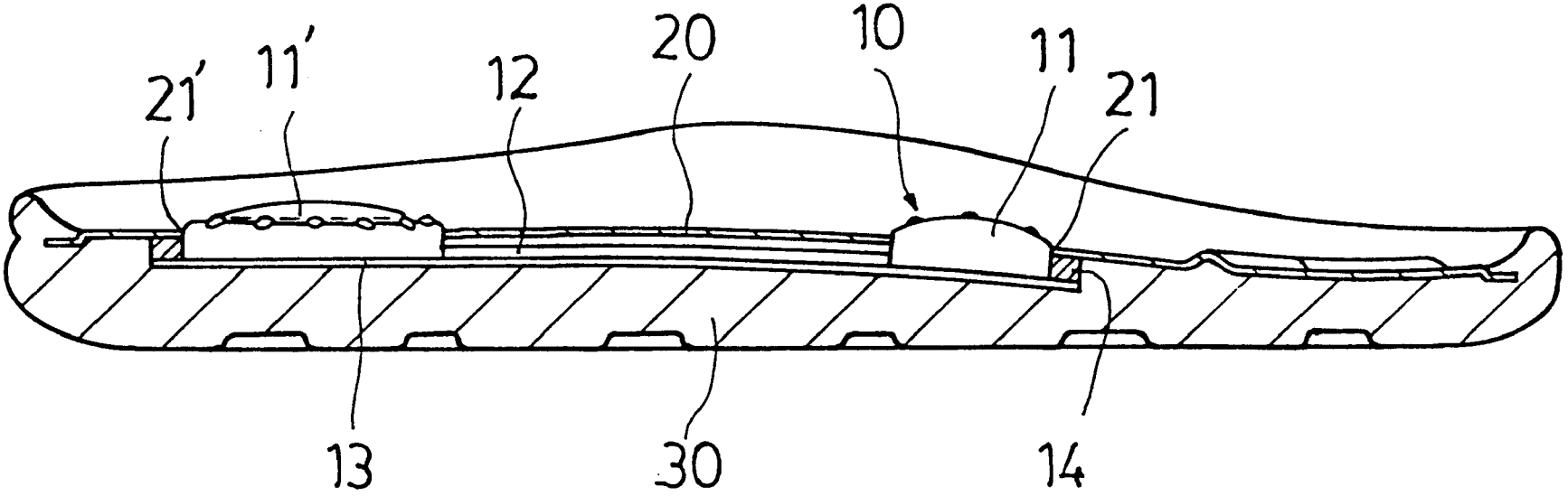
FIG. 4 is a sectional view taken along line 4A—4A of FIG. 3.

Referring to FIGS. 2, 3 and 4, a shock-absorbing rib 10 is shown comprising a flat, elongated base layer 13, two flexible water chambers 11;11' respectively raised from two ends of the flat base layer 13 at the top, and a narrow water passage 12 in communication between the flexible water chambers 11;11'. The flexible water chambers 11;11' are filled with a liquid. A flexible for example rubber packing element 14 is adhered to the flat base layer 13 of the shock-absorbing rib 10 around the flexible water chambers 11;11' and the narrow water passage 12, and maintained in flush with the periphery of the flat base layer 13. An insole 20 is provided having two through holes 21;21' near its front and rear ends corresponding to the flexible water chambers 11;11' of the shock-absorbing rib 10. The insole 20 is made from flexible, wear-resisting material. The packing element 14 is coated with a layer of adhesive, then the whole assembly of the shock-absorbing rib 10 is fastened to the insole 20 by inserting the flexible water chambers 11;11' into the through holes 21;21' from the bottom and adhering the packing element 14 to the bottom wall of the insole 20.

Referring to FIG. 3, the assembly of the aforesaid insole 20 and shock-absorbing rib 10 is then put in an outsole mold, enabling an outsole 30 to be directly molded on the shock-absorbing rib 10 and the bottom wall of the insole 20. The process of molding the outsole 30 on the assembly of the insole 20 and the shock-absorbing rib 10 can easily be achieved by various molding methods. A molding example is described hereinafter. The assembly of the insole 20 and the shock-absorbing rib 10 is put upside-down in the cavity of the bottom die, then the upper die is closed on the bottom die, and then liquid material for outsole is poured into the cavity of the mold and heated to a predetermined temperature for a predetermined length of time. After molding and cooling, the finished product is removed from the mold.

Because the outsole 30 is integral with the insole 20 and the shock-absorbing rib 10, the shock-absorbing rib 10 does not move relative to the insole 20. When the foot is pressed on the insole 20, it is supported on the flexible water chambers 11;11'. When the user walks or runs, the sole of the foot is massaged by the flexible water chambers 11;11'.

What is claimed is:

1. A shock-absorbing rib and sole mounting arrangement comprising an outsole, an insole covered on said outsole, said insole having at least one through hole, and a shock-absorbing rib retained between said insole and said outsole, said shock-absorbing rib comprising a flat base layer and at least one flexible water chamber raised from said flat base layer and extended out of said insole through said at least one through hole, wherein: said shock-absorbing rib comprises a flexible packing element having a bottom side adhered to said flat base layer around said at least one flexible water chamber and a top side adhered to a bottom wall of said insole.

* * * * *